United States Patent [19]

Roberts

[11] Patent Number: 4,746,063

[45] Date of Patent: May 24, 1988

[54] CLEANING OF SPRAYING APPARATUS

[76] Inventor: Gary S. Roberts, 15 Normanhurst Avenue, Bournemouth, BH8 9NN, England

[21] Appl. No.: 925,927

[22] Filed: Nov. 3, 1986

[30] Foreign Application Priority Data

Nov. 5, 1985 [GB] United Kingdom ..... 8527244
Mar. 19, 1986 [GB] United Kingdom ..... 8606832

[51] Int. Cl.[4] ..... B05B 15/02

[52] U.S. Cl. ..... 239/1; 239/112; 239/119

[58] Field of Search ..... 239/1, 112, 113, 106, 239/110, 104, 119, 282, 283, 525, 526, 290; 134/104; 15/406

[56] References Cited

U.S. PATENT DOCUMENTS

| | | | |
|---|---|---|---|
| 1,660,359 | 2/1928 | Schneider | 239/290 |
| 1,816,555 | 7/1931 | Ward | 239/112 |
| 2,569,125 | 9/1951 | Constantino | 239/112 |
| 3,904,431 | 9/1975 | Dinermann | 134/88 |
| 4,380,308 | 4/1983 | Greenwood | 239/113 |
| 4,522,789 | 6/1985 | Kelly et al. | 239/113 |
| 4,583,691 | 4/1986 | Smith | 239/112 |

FOREIGN PATENT DOCUMENTS 2854325 6/1981 Fed. Rep. of Germany .

*Primary Examiner*—Andres Kashnikow
*Assistant Examiner*—Karen B. Merritt
*Attorney, Agent, or Firm*—Larson and Taylor

[57] ABSTRACT

For cleaning spraying apparatus, such as a spray gun, the spray outlet is sealingly coupled to a conduit coupling (possibly after removal of an air cap). Cleaning solvent is then passed through the gun and coupling, and is collected in a reservoir without being sprayed into the open air. For a pressure feed gun, the solvent is fed without the use of a compressed gas stream. The cleaning action may be enhanced by injecting air into the solvent adjacent its entry to the gun. Solvent (and injected air) may also be passed through the gun in reverse direction. The process may be automated, with the gun held in a housing with its trigger clamped open.

10 Claims, 3 Drawing Sheets

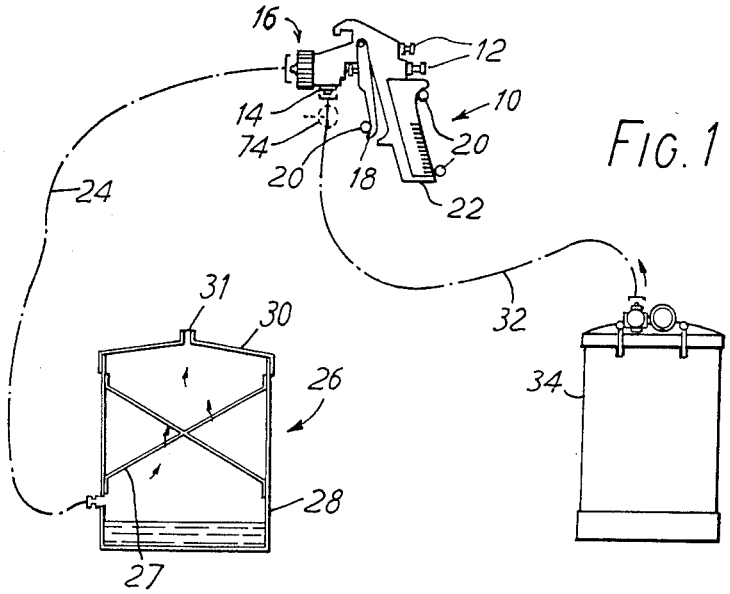
FIG. 1
FIG. 2
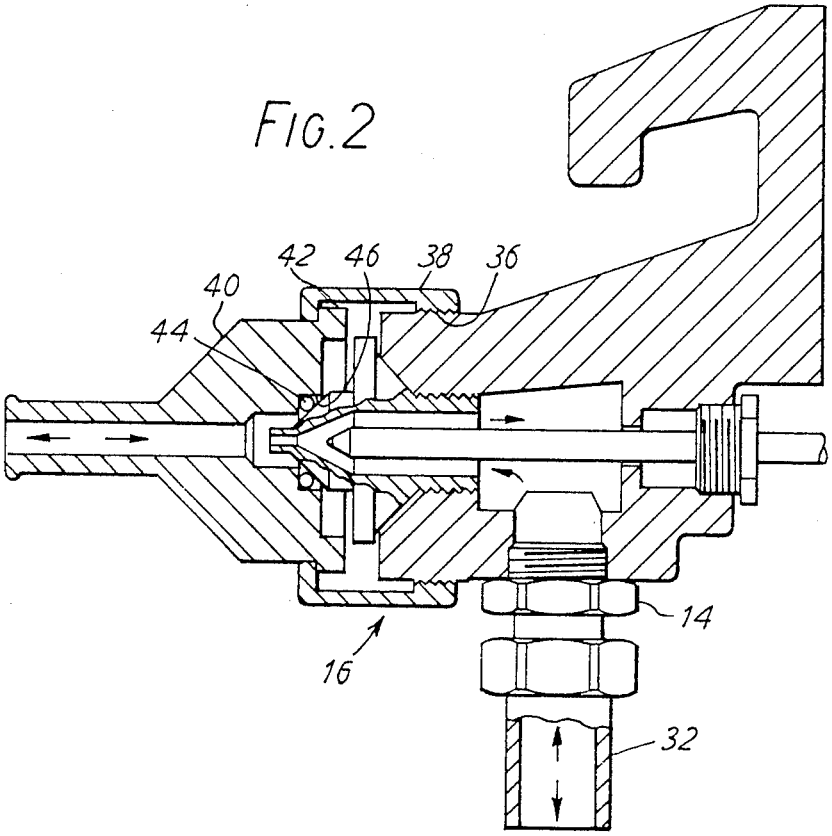

FIG. 6
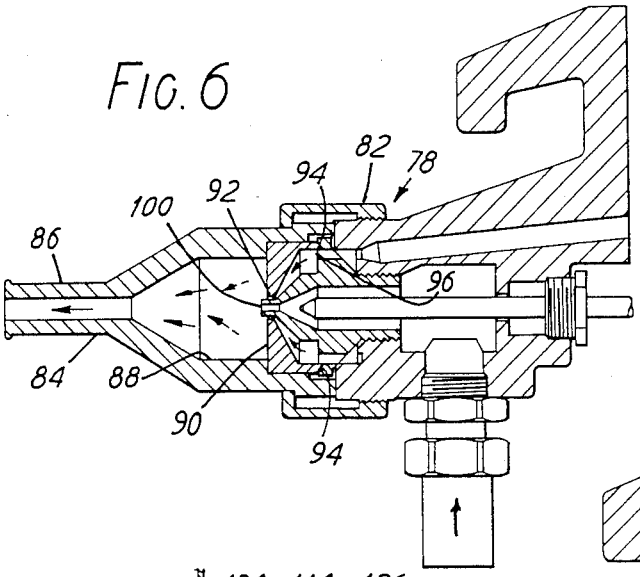
FIG. 7
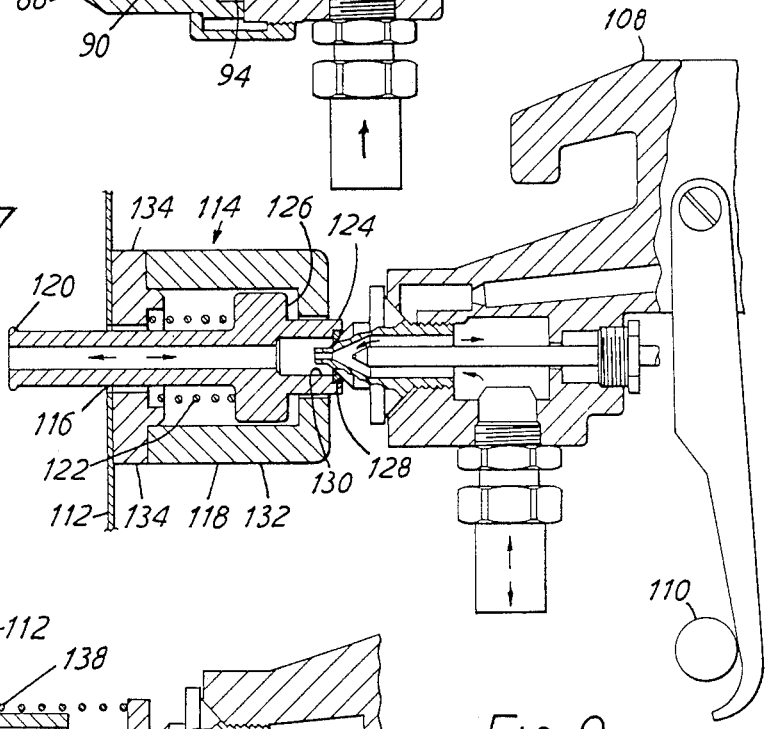
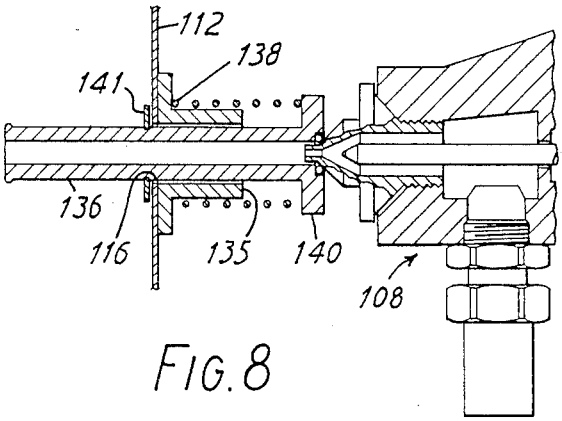
FIG. 8
FIG. 9
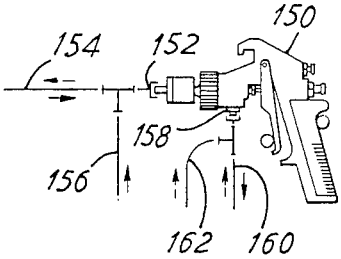

CLEANING OF SPRAYING APPARATUS

BACKGROUND OF THE INVENTION

The present invention relates to the cleaning of spraying apparatus such as spray painting guns and similar equipment. In one aspect it relates to apparatus for use in such cleaning operations. In another aspect it relates to a method of cleaning.

A conventional spray painting gun has respective inlets for supplies of compressed gas (usually air) and liquid paint. These are mixed at the outlet of the gun, and emerge as a fine spray. It is periodically necessary to clean the gun. The normal method used is simply to pass a cleaning solvent through the paint inlet, by filling the paint container with the solvent. The solvent is then sprayed in the same manner as paint, using the compressed gas supply. This is rather wasteful of both solvent and gas. Furthermore, the expelled solvent must be captured, since it will rarely be acceptable to spray it into free air. Normally a paint spray booth has means for trapping sprayed paint, often involving mixing the spray with water treated with a chemical additive. However, the usual additives are rendered ineffectual by the admixture of significant quantities of the cleaning solvent. Thus before the booth can be returned to paint spraying, the additive must be replaced, if the continued use of the booth is not to lead to an unacceptable residue and the eventual discharge of pollutants.

A further disadvantage of the known technique is that the operator has to be present, holding the gun.

GB-A No. 2 095 586 discloses means for cleaning a spray apparatus that uses a centrifugal atomiser. This is moved so that it can spray into a bowl-shaped receptacle, relative to which it must be carefully positioned. Some paint is likely to escape. The arrangement is rather cumbersome, and is only suitable for the particular type of spray apparatus.

Preferred embodiments of the present invention allow some or all of these disadvantages to be ameliorated.

SUMMARY OF THE INVENTION

In one aspect the invention provides a cleaning assembly comprising conduit means adapted for coupling to a spraying outlet of a spraying means for conveying liquid passed through that outlet to a reservoir.

The assembly may include a reservoir for cleaning liquid and means for conveying it to a spray liquid inlet of the spraying means. (The spray liquid inlet is the inlet for the liquid which the spraying means is normally used to spray, e.g. paint.) The conveying means may include a pump. The arrangement may be such that the cleaning liquid can be passed through the spraying means and out via the conduit means without the need for propulsion by a separate stream of compressed gas. The reservoir for cleaning liquid may be the same as the reservoir receiving liquid via the conduit, so that the liquid is recycled. It may be strained or otherwise cleaned before recycling. Alternatively there may be separate reservoirs (though the liquid may still be recycled, of course). There may be means for reversing the flow of liquid.

The cleaning assembly may include the spraying means.

In another aspect the invention provides a method of cleaning a spraying means which comprises coupling conduit means to a spraying outlet of spraying means and passing cleaning liquid through the spraying means to a reservoir, via the conduit means.

BRIEF DESCRIPTION OF THE DRAWINGS

FIG. 1 is a schematic view in elevation of a dead end cleaning system for a pressure feed paint spraying gun embodying the invention;

FIG. 2 is a sectional view on a larger scale of the outlet region of the spray gun shown in FIG. 1;

FIG. 6 is a sectional view on a larger scale of the outlet region of the spray gun shown in FIG. 5;

FIG. 7 is a sectional view of part of an automated system for cleaning a pressure feed gun;

FIG. 8 is a detail of a view similar to FIG. 7 showing another embodiment; and FIG. 9 is a schematic view of an automated system for cleaning a pressure feed gun.

DESCRIPTION OF THE PREFERRED EMBODIMENTS

Figure 3:
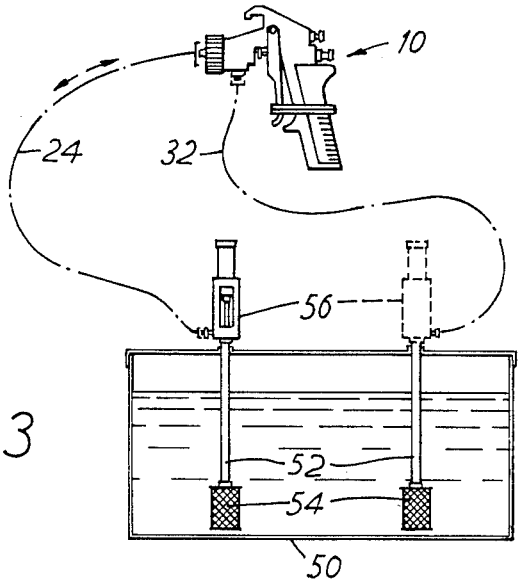
FIG. 3 is a view similar to FIG. 1 but showing a circulating cleaning system.

Referring first to FIG. 1, a conventional pressure feed spray painting gun 10 has controls 12 for compressed gas and liquid, an inlet 14 for paint; an outlet region 16; and a trigger 18 which operates a needle valve which controls the outlet passage. For cleaning, the trigger 18 is held in the spraying position. In the FIG. 1 arrangement this has been achieved by mounting the gun on a bracket 20 comprising spaced rods (three in this example) which engage the trigger 18 and a handle 22 of the gun. Of course, a clip or manual pressure could be used. At the outlet region 16, a conduit 24 is coupled, by means described later. This passes to a reservoir 26, which is a container 28 with a sealed lid 30 with an air vent 31. An input conduit 32 (which may be the standard conduit used for supplying paint) passes to the paint inlet 14 from the input reservoir 34. As shown, this is a conventional pressure feed tank such as may be used for supplying paint under pressure (e.g. using compressed gas). Alternatively there could be a pump for conveying cleaning fluid along the conduit 32 to the gun 10.

Referring now to FIG. 2, it can be seen that the outlet region 16 of the gun 10 has, adjacent the spray outlet, an external thread 36 on which is engaged a standard air cap retaining ring 38. This is being used to retain not the air cap (which is employed during paint spraying) but a special conduit coupling 40. This is a tubular bushing having an inner flange 42 which is retained by the retaining ring 38. (Alternatively the conduit coupling may have a tubular extension with an internal thread which engages the thread 36 of the gun directly, without a separate retaining ring 38.) The coupling 40 also has an outer cylindrical portion over which an end of the conduit 24 may be sealingly passed, e.g. retained by a clip. The conduit coupling 40 may be a metal pressing or a plastics moulding, or could be machined from solid material. It is provided with a seal 44 (suitably a ptfe O-ring) around its region 46 of abutment with the outlet of the gun so as to ensure fluid-tight coupling of the conduit 24 to the gun. (Since the cleaning liquid will generally be passed through the gun without the use of high pressure gas, it is an easy task to achieve an adequate seal.)

Thus, when the gun 10 has been used for spraying paint and it is desired to clean it, it is a simple matter to remove its air cap and attach the conduit coupling 40, which may already be connected via the conduit 24 to the reservoir 26. The compressed air supply is closed off, and a supply of cleaning fluid is connected. This may be achieved by filling the reservoir 34 used for paint with the cleaning fluid, or by connecting a separate reservoir, possibly via a separate, clean conduit 32. Cleaning fluid can then be passed through the gun via the conduit 32. It is never sprayed into the atmosphere, but is collected by the conduit 24 and passed to the reservoir 26. Of course this must communicate with the atmosphere so that excessive pressure does not build up. As shown in FIG. 1 the reservoir's inlet is screened from its air outlet by a baffle assembly 27 which in this example has the form of a hollow double cone. The upper and lower cones have mutually staggered apertures so that escaping air must follow a sinuous path. Entrained liquid is thus likely to be deposited on the baffles whence it runs down into the bottom of the reservoir 26. The reservoir 26 may have a maximum level detector and fluid cutoff device, so that the gun can be left to clean itself, the trigger being held open by the clip 20, without the operator being in attendance.

Desirably, cleaning liquid is passed through the gun not only in the normal flow direction but also in the reverse direction. With the apparatus of FIG. 1 this can be achieved by exchanging the positions of the conduits 32 and 24 on the paint inlet 14 and the conduit coupling 40 respectively.

FIG. 3 shows an alternative system. Instead of two separate reservoirs 26,34, there is one common reservoir 50. Each conduit 24,32 communicates with a like tube 52 which opens at a lower region of the reservoir 50 within a respective strainer 54. At least one of the conduit/tube branches incorporates a pump 56. As shown, this is located between the outlet conduit 24 and its tube 52, and an additional pump is shown in outline at the corresponding position of the other conduit 32. The operation of this system is substantially the same as that previously described. It is convenient for the pump or pumps to have a manual or automatic device for reversing the direction of liquid flow periodically. (Similarly, a system using separate reservoirs could use detection of the level in a reservoir to actuate reversal.)

Figure 4:
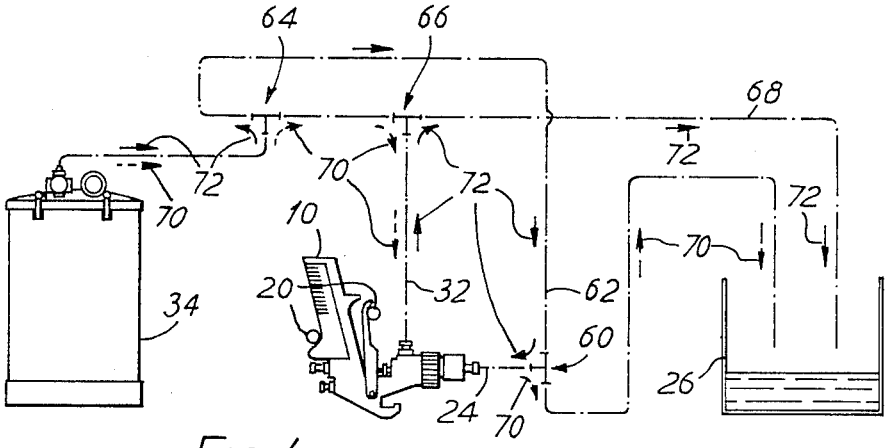
FIG. 4 is a schematic view of an automated system for cleaning a pressure feed gun.

FIG. 4 shows an automated dead end cleaning system. A gun 10 is held in a bracket 20 and coupled to an 'input' conduit 32 and an 'outlet' conduit 24 much as in FIG. 1. The 'outlet' conduit 24 passes to the waste reservoir 26. But it includes a 3-way valve 60 from which a branch 62 leads to another 3-way valve 64 adjacent the input reservoir 34. The 'input' conduit 32 is communicable with the input reservoir via a third 3-way valve 66 and the valve 64 adjacent that reservoir. The other branch 68 from the third valve 66 leads to the waste reservoir 26. In one configuration of the valves 60,64,66, cleaning liquid from the input reservoir follows the arrows 70, into the gun via the 'input' conduit 32 and out via the 'output' conduit 24. Possibly after a predetermined interval, the configuration of the valves is changed so that the cleaning liquid follows the path of the arrows 72, i.e. it enters the gun via the 'output' conduit 24, and exits to the waste reservoir 26 via the 'input' conduit 32.

It may also be arranged for gas to be introduced into the fluid stream, to provide a more aggressive cleaning action, at least for the forward flow direction. Preferably compressed air for this purpose is introduced adjacent the inlet of the gun, e.g. via a junction 74 as indicated in FIG. 1.

It is preferred for the pump(s) to operate by compressed air, suitably being of peristaltic type, though of course other types of pump or motive power may be used.

Figure 5:
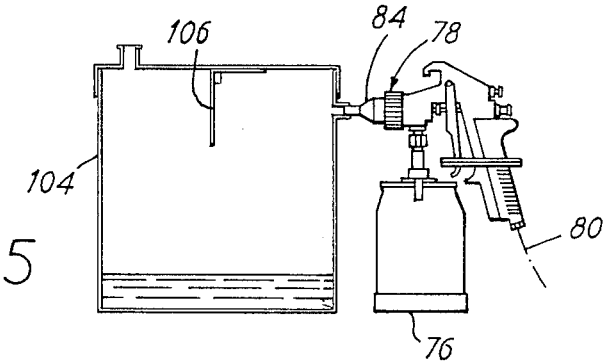
FIG. 5 is a view similar to FIG. 1 but showing a dead end cleaning system for a suction feed paint spraying gun.

FIGS. 5 and 6 concern apparatus for cleaning suction- or gravity-feed guns. As shown, a suction-feed gun has a container 76 of liquid to be sprayed connected adjacent its spray outlet region 78. A supply of compressed air is fed in (through line 80) and emerges around the outlet of the liquid supply line in the outlet region 78 in a manner so as to create a low pressure region (by the Venturi effect), which draws liquid from the container 76. This liquid is then mixed with the compressed air, and discharged as a spray. (The gun can be similar in many respects to a pressure feed gun.) Once again, it is normal to employ an air cap which is retained by a retaining ring 82. As shown in FIG. 6 this can be employed to retain a coupling 84 which in many ways resembles the coupling 40 shown in FIG. 2. Thus it has the form of a tubular bushing, with an outer nozzle portion 86 to which a conduit may be connected for use in an array similar to that of FIG. 1. At the end where the coupling 84 is coupled to the gun, its internal bore widens to a stepped cylindrical chamber 88 which contains, at the inner end, a removable core 90. This core 90 has a central opening 92. The surface confronting the gun tapers towards this opening 92, e.g. being conical as shown. Peripheral portions 94 abut the gun substantially sealingly. Radially outwardly thereof, the main body of the coupling 84 also abuts, or is closely spaced from, the gun. Generally there is a small gap, and the body is firmly urged towards the gun by means of the retaining cap 82, so that the core 90 is forced against the gun. (There may also be a sealing ring at this location.) The core 90 is dimensioned so that it embraces the air outlet passages 96 of the gun; and so that the paint outlet nozzle 100 of the gun projects through and a short way beyond the aperture 92, there being an annular space between the nozzle and the wall of the core 90 that defines this aperture. Thus when compressed air is passed through its normal paths in the gun, it is funnelled through this annular passage and then enters the relatively large cylindrical chamber beyond. There is thus provided a suction effect which tends to draw material outwardly through the nozzle 100 of the gun, substantially as during normal spraying.

FIG. 5 shows the coupling 84 passing directly into the inlet of a reservoir 104. This reservoir has a simpler form than that shown in FIG. 1, having a single downwardly directed baffle 106.

To clean a gun, it is merely necessary to remove the air cap, attach the coupling 84, put cleaning solvent in the paint container, and 'spray' this solvent through the gun and into the coupling 84 (and thence into a suitable reservoir, e.g. as shown in FIG. 5 or FIG. 1). The construction of the coupling 84 in two parts, with the removal core 90, greatly facilitates the cleaning of the coupling. Furthermore, if the core is badly soiled or damaged, it can be cheaply replaced. Thus the narrow passage between the tip of the gun and the wall defining the aperture 92 can be maintained with an efficient size and shape. Incidentally, many spray guns of this type, such as the JGV spray gun made by DeVilbiss and the BBR spray gun made by Binks Bullows, employ two series of compressed air passages. In addition to the main passages that open adjacent the tip of the gun, there are radially and forwardly displaced openings for spreader jets which serve to shape the spray of paint. These are separately controllable, and will generally be closed off during cleaning. (With a pressure feed gun, also the main air passages will be closed off during cleaning.)

Interestingly, it has been found that when the air cap of a suction feed gun is replaced by a coupling 84, spraying of solvent under normal conditions (such as flow rate of compressed air) leads to a liquid flow rate substantially greater than the normal, spraying rate, for example 2.5 times this rate. The reason for this increased rate is not yet clear, but of course it is most valuable since it enhances the cleaning effect and can thus reduce the time required for cleaning.

FIGS. 7 to 9 show further examples of apparatus for use in cleaning pressure feed guns (though similar apparatus could be used for suction feed guns). FIG. 7 shows a gun 108 whose air cap has been removed. It is mounted in a cleaning housing by means of a bracket which provides a pair of support rods 110 like the rods 20 in FIG. 1. The housing has an end wall 112, and a coupling 114 is mounted at an opening 116 in that wall. The coupling 114 includes a tubular body 118 within which a tubular piston member 120 is axially displaceable, against the action of a spring 122 which urges it into the interior of the cleaning housing. The piston 120 has an inlet nozzle 124 which projects through an opening in the inner face of the body 118; and a shoulder portion 126 which is urged by the spring 122 to abut that face. The nozzle portion 124 is adapted to abut the outlet of the gun 108 in much the same way as the coupling 40 as shown in FIG. 2. Thus a sealing ring 128 is arranged to abut a frustoconical surface of the gun outlet, which outlet projects some way within an enlarged bore portion 130 of the nozzle portion 124. The coupling 114 is mounted relative to the bracket 110 such that, having regard to the dimensions of the guns with which it is to be used, the gun can be mounted in the bracket so that its outlet engages in the nozzle, sealing to the ring 128. Generally the piston 120 will be displaced rearwardly by the gun, so that it is urged into sealing contact with the gun's outlet by the spring 122.

The coupling shown in FIG. 7 has three main parts. The body 118 comprises a cup member 132 (with an apertured base) and a closure plate 134. The third member is the piston 120 which is generally within the body, and which has a rear portion which extends slidably through an opening in the closure plate 134. The closure plate 134 may snap engage with the cup member 132, thus compressing the spring 122 between the plate 114 and the shoulder 126 of the piston. FIG. 8 shows a simplified variant which has only two main portions: a tubular bushing 135 and a tubular piston 136. The bushing 135 has a rear flange whose rear face abuts the wall 112 of the cleaning housing, and whose front face provides an abutment for a spring 138 which is braced against an enlarged head 140 at the inner end of the piston. This head provides a sealing abutment for the outlet of the gun 108. The piston 136 extends through the opening 116 in the wall 112 and bears a clip 141 to retain the assembly in place.

Apparatus as shown in FIGS. 7 and 8 is very suitable for automatic operation, e.g. as shown schematically in FIG. 9. This shows a pressure feed gun 150 with a coupling 152 at its spray outlet. From the coupling 152, a conduit 154 leads to a source and/or a collector for cleaning liquid. Adjacent the coupling 152 there is a junction for a compressed air inlet line 156. The paint inlet 158 of the gun is connected to a conduit 160 leading to a source and/or collector for cleaning liquid. Adjacent the inlet 158 there is a junction for a compressed air line 162.

The following automatic cleaning sequence may be carried out. Initially, cleaning liquid is passed through the gun via conduit 160 and the paint inlet, its cleaning effect being increased by the inclusion of compressed air passed through line 162. Dirty liquid from the gun passes along conduit 154 to a collector. After a predetermined interval, the inputs of liquid and air along conduits 160 and 162 are stopped, and conduit 160 is connected to a collector. The conduit 154 is connected to a source, and cleaning liquid is then backflushed through the gun, emerging through conduit 160. This backflush may also be enhanced by compressed air injection via line 156. Finally, there may be a compressed air purge.

A number of preferred embodiments of the invention have been described, but the skilled reader will appreciate that much variation is possible. In particular, features described in connection with one embodiment may generally be combined with features described in connection with another. The invention can readily be applied to robot, automatic and semi-automatic spray guns; and to spray guns not only for spray painting but also as used for operations in other fields such a food technology (e.g. spray drying of milk), and ceramics.

Whereas the invention has been described above by reference to preferred embodiments it will be understood by those skilled in the art that various changes may be made without departing from the spirit and scope of the invention, and it is intended to cover all such changes by the appended claims.

I claim:

1. A spraying means cleaning assembly which comprises: a spraying means having a spraying outlet; and conduit means adapted to be sealingly coupled to the outlet, for conveying liquid passed through that outlet to a reservoir; wherein said spraying means is adapted to operate in normal spraying use by suction feed; said spraying outlet comprises a liquid outlet nozzle with adjacent gas outlet means for producing a liquid sucking action during normal spraying use; and wherein the conduit means is adapted to embrace the nozzle and gas outlet means, and comprises a conduit portion substantially closed by a wall portion having an aperture slightly larger than the nozzle, arranged so that the nozzle can project slightly beyond the wall portion, and gas passed through the gas outlet means can then pass through the aperture about the nozzle to produce a liquid sucking action to draw liquid from the nozzle.

2. A cleaning assembly according to claim 1 wherein the spraying means has an air cap retaining ring for retaining an air cap during normal spraying; and the conduit means comprises a coupling which is engageable by the retaining ring to effect said sealing coupling.

3. A cleaning assembly according to claim 1 wherein the spraying means comprises a spray gun which includes a trigger control for liquid to be sprayed, and the assembly includes a mounting for the gun arranged to maintain the trigger control in a spraying configuration.

4. A cleaning assembly according to claim 3 including a housing; the conduit means and the gun mounting being mounted to said housing in a relationship such that they are simultaneously engageable by the gun.

5. A cleaning assembly according to claim 1 in which the wall portion is separate from the conduit portion and is removable.

6. A cleaning assembly according to claim 1 having cleaning liquid supply means for supplying cleaning liquid to the spraying means; and compressed gas supply means arranged to pass gas into liquid supplied to the spraying means by the cleaning liquid supply means.

7. A method of cleaning a pressure-feed spraying means having an inlet for pressurized liquid to be sprayed and an inlet for compressed gas for use in normal spraying, the method comprising sealingly coupling the proximal end of a conduit to its spraying outlet and coupling the distal end of the conduit to a reservoir, and passing cleaning liquid through the spraying means and out through the conduit to said receptacle without using the compressed gas inlet; and wherein, in successive time intervals, cleaning liquid is passed through the spraying means both in the normal spraying direction and in the reverse direction.

8. A method according to claim 7 wherein the spraying means is a suction feed device which in normal use employs a gas stream to suck liquid for spraying from a reservoir; and wherein the passing of liquid for cleaning is effected by the gas stream.

9. A pressure feed spraying means cleaning assembly comprising a pressure feed spraying means having a spraying outlet and having an inlet for pressurized liquid to be sprayed and an inlet for compressed gas for use in normal spraying; conduit means adapted to be sealingly coupled at its proximal end to the spraying outlet; cleaning liquid reservoir means coupled to the distal end of the conduit means; and fluid flow control means whereby cleaning fluid is passable through the spraying means along a flow path including the inlet for pressurized liquid to be sprayed, the spraying outlet, and the conduit means sealingly coupled thereto; the fluid flow control means including means adapted for alteration of the direction of the flow of cleaning fluid through the spraying means.

10. A cleaning assembly according to claim 9 having cleaning liquid supply means for supplying cleaning liquid to the spraying means; and compressed gas supply means arranged to pass gas into liquid supplied to the spraying means by the cleaning liquid supply means.

* * * * *